US006196179B1

(12) United States Patent
Frantzheld

(10) Patent No.: US 6,196,179 B1
(45) Date of Patent: Mar. 6, 2001

(54) INTERNAL COMBUSTION ENGINE

(75) Inventor: Gerolf Frantzheld, Aichwald (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/552,049

(22) Filed: Apr. 19, 2000

(30) Foreign Application Priority Data

Apr. 20, 1999 (DE) ..... 199 17 707

(51) Int. Cl.[7] ..... F02F 1/20
(52) U.S. Cl. ..... 123/193.2; 277/234
(58) Field of Search ..... 123/193.2, 193.3, 123/193.4; 277/234, 313, 593

(56) References Cited

U.S. PATENT DOCUMENTS

| | | | | |
|---|---|---|---|---|
| 3,882,842 | * | 5/1975 | Bailey et al. | 123/193.2 |
| 4,474,147 | * | 10/1984 | Hoopes | 123/193.4 |
| 5,112,066 | * | 5/1992 | Remmerfelt | 123/193.4 |
| 5,553,585 | | 9/1996 | Paro . | |
| 5,582,144 | * | 12/1996 | Mizutani | 123/193.2 |
| 5,921,558 | * | 7/1999 | Kozerski | 277/593 |
| 5,934,682 | * | 8/1999 | Miszczak et al. | 277/313 |
| 5,970,612 | * | 10/1999 | West | 277/234 |

FOREIGN PATENT DOCUMENTS

| | | |
|---|---|---|
| 1 902 502 | 11/1970 | (DE) . |
| 36 10 541 | 10/1987 | (DE) . |
| 195 48 403 | 7/1997 | (DE) . |

* cited by examiner

*Primary Examiner*—Marguerite McMahon
(74) *Attorney, Agent, or Firm*—Klaus T. Bach

(57) ABSTRACT

In an internal combustion engine with an engine block, a cylinder head mounted onto the engine block, a cylinder head gasket disposed between the engine block and the cylinder head, a piston disposed in a cylinder formed in the engine block and a cylindrical ring arranged in a recessed area between the piston and a cylinder area around the top land of the piston in the top dead center position of the piston, the cylindrical ring is formed as part of the cylinder head gasket.

8 Claims, 1 Drawing Sheet

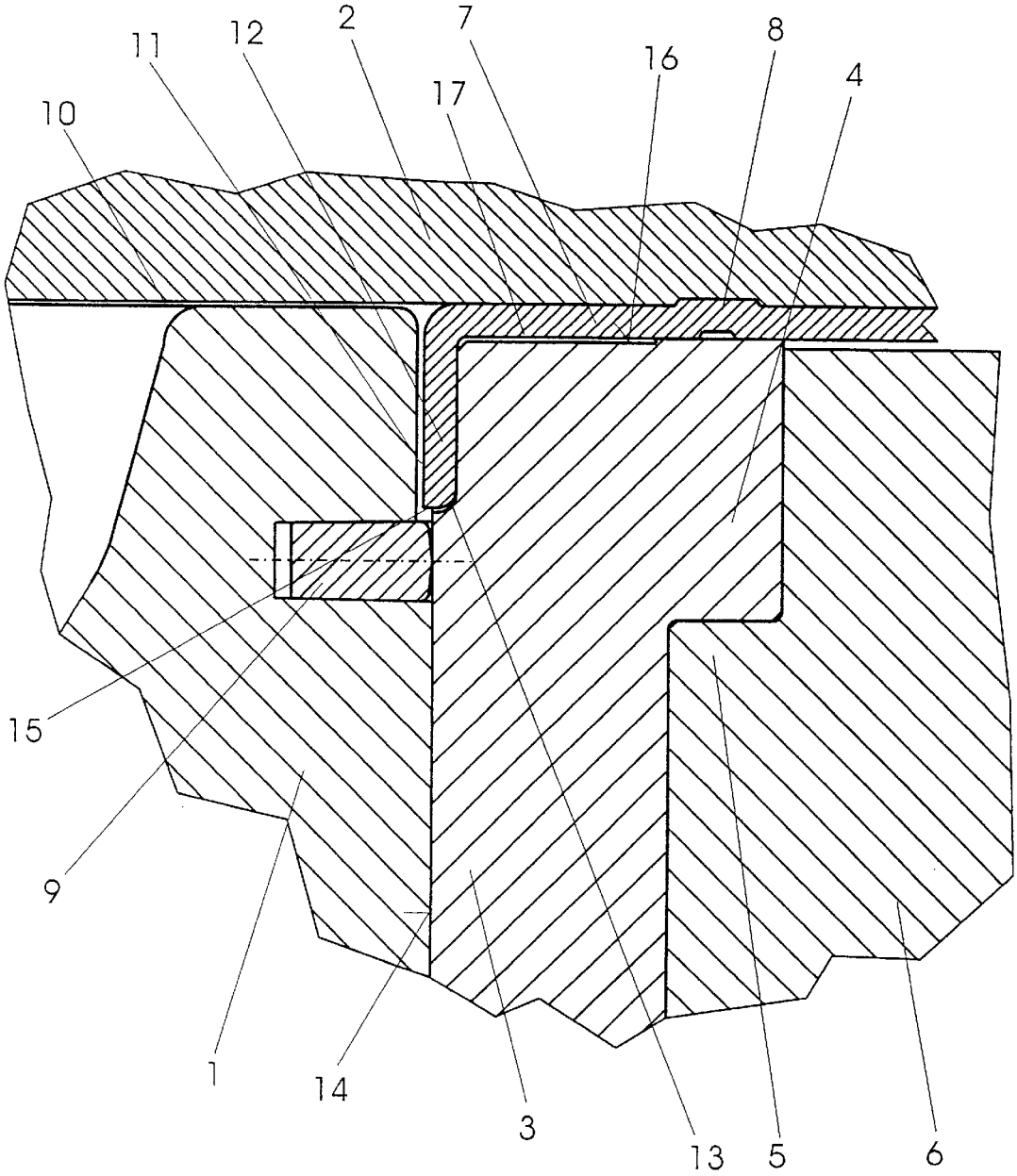
2
7
8
11
12
16
4
17
10
15
9
1
14
3
13
5
6

INTERNAL COMBUSTION ENGINE

BACKGROUND OF THE INVENTION

The invention relates to an internal combustion engine with an engine block and a cylinder head, between which a cylinder head gasket is disposed, and a piston arranged in a cylinder having a cylinder surface with cylindrical ring disposed between the piston and the cylinder surface.

In modern internal combustion engines, particularly Diesel engines, it is necessary to provide sufficient play for the top land of the piston so that, at the operating temperature and the corresponding expansion of the aluminum piston, no contact occurs between the top land of the aluminum piston and the surrounding cylinder wall. The top land of a piston is the area between the uppermost piston ring, which is closest to the cylinderhead and the upper edge of the piston.

Especially with the use of synthetic oils for the lubrication of the internal combustion engine, there is the disadvantage that hard deposits are formed by combustion of the synthetic lubricant, which build up in the area of the top land and which finally contact the cylinder surface. During the reciprocating movement of the piston the hard deposits may then destroy the hone structure formed into the cylinder walls during manufacture. Then the cylinder surface loses the surface structure required for retaining a sufficiently thick lubricating oil film on the cylinder surface, which results in a high lubricating oil consumption and faster wear of the cylinder and the piston.

To avoid those effects, a cylindrical ring is being inserted in the area of the cylinder surface adjacent the cylinder head, that is, a recess is provided in the cylinder wall adjacent the cylinder head for receiving such a ring. The cylindrical ring projects from the cylinder wall surface and causes dislodging of the deposits in the area of the top land of the piston.

Such an arrangement is disclosed in principle in DAS 1 902 502. Furthermore, U.S. Pat. No. 5,553,585 describes a complex embodiment of such a ring arrangement.

It is however a disadvantage that such a ring requires space in radial direction which results in increased engine volume: For manufacturing reasons, the cylindrical ring has to have a certain wall thickness in order to be stable and to facilitate handling during assembly.

This is especially critical if the wall thickness behind the cylinder surface is already very small since for example a cylinder sleeve is inserted. In this case, high material tensions occur and a notch effect is generated in that area in which the cylinder sleeve has a very small wall thickness.

It is therefore the object of the present invention to provide an internal combustion engine with a cylindrical ring which provides for a gap between the top land of a piston and the respective cylinder wall surface. The cylindrical ring should require only minimal space in radial direction of the cylinder.

SUMMARY OF THE INVENTION

In an internal combustion engine with an engine block, a cylinder head mounted onto the engine block, a cylinder head gasket disposed between the engine block and the cylinder head, a piston disposed in a cylinder formed in the engine block and a cylindrical ring arranged in a recessed area between the piston and a cylinder area around the top land of the piston in the top dead center position of the piston, the cylindrical ring is formed as part of the cylinder head gasket.

Since the cylindrical ring according to the invention is an integral part of the cylinder head gasket, the wall thickness of the cylindrical ring can be substantially reduced as compared to all the known designs. The cylindrical ring which is formed with the base body of the cylinder head gasket has a minimal wall thickness, but is held in it proper shape by the base body of the cylinder head gasket.

Only the single-piece combination of the cylinder head gasket and the cylindrical ring in accordance with the invention has facilitated the manufacture of such a thin-walled ring. The base body of the cylinder head gasket mainly serves as a shape-maintaining aid and only secondarily as a support structure for the cylindrical ring. Consequently, the base body of the cylinder head gasket provides for a relatively high shape-rigidity of the cylindrical ring formed onto the cylinder head gasket.

In a particularly advantageous embodiment of the invention, the areas of the cylinder surfaces in a engine block directly adjacent the cylinder head are provided with recesses. The cylinder surface however may be part of a cylinder sleeve so that also the recesses are formed into the cylinder sleeves.

With the recesses formed into the areas of the cylinder sleeve or respectively, the engine block adjacent the cylinder head, the areas of the cylinder head gasket directly adjacent the cylindrical ring are not exposed to the pressure generated by the cylinder head.

This has the advantage that the cylinder head gasket seals around each cylinder only in the area of a stiffening corrugation formed into the gasket around each cylinder. In this way no uncontrolled forces are transmitted between the cylinder head and the engine block, or respectively, the cylinder sleeve. In addition, undetermined static clamping forces between the areas of the cylinder head surrounding the cylindrical ring and the engine block or, respectively, the cylinder sleeve are avoided. Also, the force transmission and the force flow from the cylinder head to the engine block can be well controlled.

Further advantageous embodiments of the invention will be described below on the basis of the accompanying drawings.

BRIEF DESCRIPTION OF THE DRAWINGS

The sole FIGURE is a cross-sectional view of an internal combustion engine showing particularly the area between a piston, a cylinder head and a cylinder sleeve.

DESCRIPTION OF PREFERRED EMBODIMENT

The figure shows a piston 1 disposed in an cylinder sleeve 3 below a cylinder head 2. The cylinder sleeve is formed as a so-called hanging cylinder sleeve, which has a widened portion 4 in the area adjacent the cylinder head 2. The widened area 4 forms a flange disposed on a shoulder 5 of the engine block 6. The cylinder sleeve 3 "hangs" with its flange 4 on the shoulder 5 of the engine block 6. Between the cylinder head 2, and the area of the cylinder sleeve 3 adjacent the cylinder head 2, a cylinder head gasket 7 is disposed. The cylinder head gasket 7 includes a sealing corrugation 8, which is arranged directly above the flange 4 and the shoulder 5 and which provides for a statically well-defined and controllable force transmission. It also provides for good sealing between the cylinder head 2 and the cylinder sleeve 3 and, respectively, the cylinder block 6. The piston 1 includes several piston rings 9, which seal the space 10 between the piston 1 and the cylinder head 2 with respect to the space below the piston 1. The single figure shows only one of the piston rings that is the piston ring closest to the cylinder head, which is called the first piston ring 3.

The area of the piston 1 disposed between the first piston ring 9 and the cylinder head 2 around the top 1 and of the piston when the piston is in its top dead center position is called the fire barrier 11. In the embodiment shown herein, the space of the fire barrier 11 is defined by a cylindrical ring 12, which is formed as a single piece, or integrally with the cylinder head gasket 7. This cylindrical ring 12 is disposed, without play, in a recess 13 provided therefor in the cylinder sleeve 3. The cylindrical ring 12 is immovably disposed in the area of the fire barrier 11. It cannot rotate and cannot come into contact with the piston 1 since the cylindrical ring 12 is fixed in the recess 13 by the cylinder head gasket connected thereto without play in axial and in radial direct ions.

When the piston 1 is disposed in its upper dead center position, the cylindrical ring extends almost over the whole area between the cylinder head 2 and the position of the first piston ring 9. In this way, the space of the fire barrier 11 is almost fully filled so that deposits of oil carbons in the form of a hard coating on the piston top land is essentially prevented. The small amount of oil carbon, which can still be formed in the remaining small unoccupied area of the fire barrier 11 is stripped off during movement of the piston 1 by the edge 15 of the cylindrical ring 12 projecting beyond the surface of the cylinder wall 14 when the piston is in its upper dead center position so that carbon deposits cannot build up on the piston top land. The remaining very fine oil carbon particles can then be carried out of the area of the fire barrier 11 and the space 10 above the piston 1 by the exhaust gases leaving the cylinder.

With the single piece or integral arrangement of the cylinder head gasket 7 and the cylindrical ring 12, the wall thickness of the cylindrical ring 12 may be very small since the base plate of the cylinder head gasket 7 serves as an aid maintaining the shape of the cylindrical ring 12.

The part of the cylinder sleeve 3 disposed between the projection 5 of the engine block 6 and the recess 13 in the cylinder sleeve 3 can therefore be relatively large without resulting in an increase of the mechanical tension in the cylinder sleeve 3 to a degree that would be critical for the cylinder sleeve material. As a result, for example, cooling passages (not shown) can be arranged between the engine block 6 and the cylinder sleeve 3 very close to the recess 13 or, respectively, the flange 4 without the groove effect reaching critical values.

In order to prevent the occurrence of a statically undetermined state between the cylinder head 2 and the cylinder sleeve 3 or, respectively, the engine block, the cylinder head gasket includes the sealing corrugation as pointed out above. In addition, the surface 16 of the cylinder sleeve 3 includes a recess 17 at its side facing the cylinder head 2. In this way, the cylinder head gasket 7 is not subjected to compression in its area above the recess 17 so that a statically defined engagement and sealing occurs only at the sealing corrugation 8 of the cylinder head gasket 7. In addition to the statically defined engagement, a force transfer is therefore achieved which is well determined as to it location. It permits the controlled transfer of forces from the cylinder head 2 by way of the sealing corrugation 8 of the cylinder head gasket 7 and the flange 4 of the cylinder sleeve 3 to the shoulder 5 of the engine block 6.

Alternatively, the recess 17 may also be realized as a chamfer. In that case, the part of surface 16, which is disposed in the area of the recess 17, is arranged at an angle somewhat different from 90° with respect to the cylinder surface 14. With such an, in radial direction, relatively long chamfer, a recess 17 could also be realized.

The single piece or integral arrangement of the cylinder head gasket 7 and the cylindrical ring 12 can of course also be realized with any other type of cylinder sleeve or with the engine block having cylinder surfaces 14 directly formed therein. The arrangement then needs to be slightly changed, but all the advantages remain the same.

Preferably, the cylindrical ring 12 has a wall thickness of 0.5 to 2 mm.

The cylindrical ring may be attached so as to be part of the gasket or it may also be formed from the gasket by bending the gasket around the cylinder openings therein so as to extend perpendicularly thereto.

What is claimed is:

1. An internal combustion engine with an engine block having a top surface and a plurality of cylinders with cylinder surfaces, a cylinder head disposed on said engine block, a piston disposed in each cylinder formed in the engine block and a cylinder head gasket disposed between the engine block and the cylinder head, said cylinder head gasket including, formed integrally therewith for each cylinder, a cylindrical ring structure extending axially into a space between the piston and a cylinder surface area surrounding said piston in the top dead center position of said piston.

2. An internal combustion engine according to claim 1, wherein said cylindrical ring is disposed, without play, in a recess of said cylinder surface area.

3. An internal combustion engine according to claim 2, wherein cylinder sleeves are disposed in said engine block to form said cylinders and said cylinder sleeves have flanges seated on shoulders formed in said engine block, and areas are formed in the top surfaces of the cylinder sleeve adjacent said cylinder head around each of said recesses formed in said cylinder surface, whereby said gasket is engaged between the flange area of said cylinder sleeve and said cylinder head so that the engagement forces between said cylinder head and said engine block are transmitted solely through said flange.

4. An internal combustion engine according to claim 3, wherein said recessed area around each cylinder has a surface area extending from said cylinder surface radially outwardly at an angle other than 90°.

5. An internal combustion engine according to claim 1, wherein said cylindrical ring structures extend from the cylinder head gasket into each of said cylinders to a location adjacent an uppermost piston ring of said piston when said piston is in its upper dead center position.

6. An internal combustion engine according to claim 2, wherein said cylindrical ring projects from said recess radially into said cylinder toward said piston beyond the surface area of said cylinder.

7. An internal combustion engine according to claim 1, wherein said cylindrical ring structures have a wall thickness of 0.5 to 2 mm.

8. An internal combustion engine according to claim 1, wherein said cylindrical ring structures are formed from the material of which said cylinder head gasket consist by bending over of said gasket around said cylinder.

* * * * *